US008654163B2

(12) United States Patent
Yamada

(10) Patent No.: US 8,654,163 B2
(45) Date of Patent: Feb. 18, 2014

(54) PRINT HEAD, PRINTER, AND CONTROL METHOD OF PRINTER

(71) Applicant: Seiko Epson Corporation, Tokyo (JP)

(72) Inventor: Rikuo Yamada, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/866,090

(22) Filed: Apr. 19, 2013

(65) Prior Publication Data

US 2013/0229480 A1 Sep. 5, 2013

Related U.S. Application Data

(63) Continuation of application No. 13/210,451, filed on Aug. 16, 2011, now Pat. No. 8,446,441.

(30) Foreign Application Priority Data

Aug. 17, 2010 (JP) ..... 2010-182125
Aug. 4, 2011 (JP) ..... 2011-170775

(51) Int. Cl.
*B41J 25/304* (2006.01)

(52) U.S. Cl.
USPC ..... 347/197

(58) Field of Classification Search
CPC ..... B41J 25/304
USPC ..... 347/197; 400/120.16
See application file for complete search history.

(56) References Cited

U.S. PATENT DOCUMENTS 5,599,113 A 2/1997 Suzuki et al.
5,806,996 A 9/1998 Leys et al.
7,940,291 B2 * 5/2011 Koyabu ..... 347/218
8,446,441 B2 * 5/2013 Yamada ..... 347/197
2005/0285888 A1 12/2005 Haney et al.
2007/0229643 A1 10/2007 Takahashi
2010/0002065 A1 1/2010 Koyabu

FOREIGN PATENT DOCUMENTS

| | | | | |
|---|---|---|---|---|
| CN | 1931673 A | | 3/2007 | |
| JP | 63-092465 | | 4/1988 | |
| JP | 05-155100 | * | 6/1993 | ..... 347/197 |
| JP | 2710656 | | 10/1997 | |
| JP | 10-086421 | | 4/1998 | |
| JP | 10-157052 | | 6/1998 | |
| JP | 3004174 | | 11/1999 | |
| JP | 2000-222536 | | 8/2000 | |
| JP | 2006-334858 | | 12/2006 | |
| JP | 2010-012730 | | 1/2010 | |

OTHER PUBLICATIONS

Computer-generated translation of JP 05-155100, published on Jun. 1993.*

European Search Report for application No. 11177703.3 dated Dec. 12, 2011.

* cited by examiner

*Primary Examiner* — Huan Tran

(57) ABSTRACT

In connection with a printer, a platen roller is configured to transport a recording medium. A print head has a head body portion having a printing portion which performs printing on a recording medium and facing the platen roller. A supporting mechanism supports the head body portion, presses the head body portion against the platen roller and moves the head body portion by rotation of the platen roller. When the platen roller rotates in a second direction opposite the first direction, a contact position of the head body portion with respect to the platen roller is shifted while maintaining the head body portion pressed against the platen roller.

2 Claims, 4 Drawing Sheets

PRINT HEAD, PRINTER, AND CONTROL METHOD OF PRINTER

CROSS-REFERENCE TO RELATED APPLICATIONS

This application is a continuation of, and claims priority under 35 U.S.C. §120 on, application Ser. No. 13/210,451, filed Aug. 16, 2011, which claims priority under 35 U.S.C. §119 on Japanese Patent Application Nos. 2010-182125 and 2011-170775, filed Aug. 17, 2010 and Aug. 4, 2011, respectively. Each of the above-identified priority applications is hereby expressly incorporated by reference herein in its entirety.

BACKGROUND

The present invention relates to a supporting mechanism for a print head, a printer and a control method of a printer, in particular, to a supporting mechanism for a print head in a printer that performs printing while transporting a recording medium by rotationally driving a platen roller in a state that the recording medium is nipped and pressed between the print head and the platen roller, a printer comprising the supporting mechanism for the print head, and a control method of the printer.

There is a printer including a print head and a platen roller which is disposed so as to face the print head. The printer performs printing while transporting a recording medium by nipping the recording medium between the print head and the platen roller. The printer sometimes goes into a standby state under a condition that the recording medium is nipped between the print head and the platen roller and a long time may have elapsed under a condition that the recording medium is pressed against the print head. In such the printer, when printing is performed on a recording medium which is liable to stick under the pressed condition, such as a recording medium having a printing face applied with a coating, there is a possibility that the recording medium is stuck to the print head in a case where the recording medium is left in the standby state for a long time period.

JP-A-2006-334858 discloses a thermal printer that performs an operation for eliminating the sticking which occurs due to a state in which a recording medium (a label) is pressed against a print head (a thermal head) for a long time period. In the thermal printer, when a printing standby state continues for a predetermined time period or more, a control of rotationally driving a platen roller in backward and forward directions under a condition that the print head is fixed is performed, and thereby the recording medium stuck to the print head is repeatedly pulled back and forth along a transporting direction of the recording medium so as to be peeled from the print head.

JP-A-2006-334858 discloses a configuration in which the recording medium is to be moved in the backward and forward directions under a condition that the print head is pressed and fixed against the platen roller, and the recording medium is peeled from the print head by a shear force. However, in a case where a recording medium is strongly stuck to the print head, a shear force necessary for peeling the recording medium from the print head exceeds a rotational driving force of the platen roller by a conventional motor and is beyond a range of a transmission performance of a force due to friction or the like between a conventional platen roller and the recording medium. Therefore, there is a possibility that the platen roller slips and is not able to transport the recording medium. Consequently, the recording medium is not able to be pulled by a sufficient force so that there is a possibility that the sticking is not eliminated.

SUMMARY

It is therefore an object of at least one embodiment of the present invention to provide a printer that can readily peel a recording medium even in a case where the recording medium is strongly stuck to a print head, and to provide a supporting mechanism for a print head of the printer and a control method of the printer.

According to an aspect of the embodiments of the present invention, there is provided a print head comprising: a head body facing a platen roller configured to transport a recording medium and having a printing portion that performs printing on the recording medium when the platen roller rotates in a first direction and transports the recording medium; and a supporting mechanism that supports the head body portion, presses the head body portion against the platen roller and moves the head body portion by rotation of the platen roller. When the platen roller rotates in a second direction opposite the first direction, a contact portion of the head body portion with respect to the platen roller is shifted while maintaining the head body portion pressed against the platen roller.

With this configuration, in a case where a recording medium is stuck to the recording head, it is possible to release a portion to which the recording medium is stuck (a portion of the head body portion, which is pressed by the platen roller) from a pressure of the platen roller. For example, by acting a force toward the movable direction of the print head, the recording medium and the print head can be moved together with each other so that the portion to which the recording medium is stuck can be removed from a pressing position of the platen roller. When the portion is released from the pressure, it is possible to move the recording medium in a direction of peeling and raising the recording medium from the print head. In a case where the recording medium is peeled and raised, the recording medium can be peeled by a force smaller than that in a case where it is peeled only by a shear force. In addition, by moving the print head under a condition that the recording medium is stuck to the print head so as to slacken the recording medium or move the recording medium to a position out of a regular transportation path, it is possible to apply a force of peeling the recording medium from the print head. Consequently, it is possible to readily eliminate the sticking of the recording medium with a high success rate.

The head body portion may be moved with the supporting mechanism by a rotation of the platen roller in a first direction or a rotation of the platen roller in a second direction opposite to the first direction. With this configuration, it is possible to perform the sticking eliminating operation by a transportation operation by using an existing platen roller so that it is not necessary to newly provide a driving source for moving the print head. Therefore, it is possible to achieve elimination of the sticking at low cost by obviating the need for complicating the structure of the device. In addition, since the recording medium is transported along a usual transporting direction of the recording medium, it is possible that the recording medium is slackened at an upstream side or downstream side of the print head in the transporting direction and to apply a force of peeling and raising the recording medium.

The supporting mechanism may include a rotation support surface that comes in contact with a rotary shaft which is parallel to a rotational axis line of the platen roller, and a guide surface which is continuous to the rotation support surface and that extends toward a side of the contact position of the head body portion with respect to the platen roller. The rotation support surface or the guide surface may be pressed against the rotary shaft by a contact between the head body portion and the platen roller, the rotary shaft may move relative to and along the guide surface so as to move the contact position of the head body portion with respect to the platen roller, and the supporting mechanism may rotate about the rotary shaft at the rotation support surface so as to move the contact position of the head body portion with respect to the platen roller. With this configuration, since the guide surface is provided on the print head and the rotary shaft pressed against the guide surface is made to be slidable, the print head can be moved in parallel in a direction of deviating the pressed portion while the print head is supported by the rotary shaft.

In the supporting mechanism, the guide surface may be inclined in a direction of extending to a back side of the head body portion as it goes to a side of the rotation support surface. With this configuration, as the rotary shaft moves in parallel with and along the guide surface to move the pressing position, the print head can be retracted toward the back side of the head body portion. Consequently, as a portion to which the recording medium is stuck is separated from the pressing position, the portion is moved to a position out of the transportation path. In association with this movement, a rising angle of the recording medium with respect to a sticking face is increased so that a larger force of peeling and raising the recording medium from the head face can act. Therefore, it is possible to immediately eliminate the sticking of the recording medium.

According to another aspect of the embodiments of the present invention, there is provided a printer, comprising: a platen roller configured to transport a recording medium; a print head that has a head body portion having a printing portion which performs printing on a recording medium when the platen roller rotates in a first direction and transports the recording medium and facing the platen roller; an urging unit that urges the head body portion toward the platen roller; and a supporting mechanism that supports the head body portion, presses the head body portion against the platen roller and moves the head body portion by rotation of the platen roller. When the platen roller rotates in a second direction opposite the first direction, a contact position of the head body portion with respect to the platen roller is shifted while maintaining the head body portion pressed against the platen roller.

The printer may further comprise: a transportation path that transports the recording medium to the contact position between the platen roller and the head body portion; and a guide member positioned in the transportation path at the same side with a direction in which the head body portion moves relative to the platen roller and configured to guide the recording medium. Thus, when a movement path of the recording medium is restricted by providing the guide member at a side where the print head is moved, the recording medium has to be slackened in a short interval from the guide member to the print head so that a rising angle with respect to a sticking face of the recording medium is surely increased. Accordingly, the force of peeling and raising can positively act.

According to still another aspect of the embodiments of the present invention, there is provided a control method for a printer, comprising: receiving an execution command of an operation including rotation of a platen roller in a first direction and transportation of a recording medium; counting a duration of a printing standby state until the execution command is received; and moving a head body portion of a print head by rotation of the platen roller in a second direction opposite the first direction. A contact position of the head body portion with respect to the platen roller is shifted while maintaining the head body portion pressed against the platen roller when the duration of the printing standby state exceeds a predetermined limited period.

In accordance with the aspects of the embodiments of the present invention, in a case where the recording medium is stuck to the print head, it is possible to release a portion to which the recording medium is stuck, from a pressure of the platen roller by moving the print head. At the portion released from the pressure, it is possible to move the recording medium in a direction of peeling and raising the recording medium from the print head. In addition, by moving the print head under a condition that the recording medium is stuck to the print head so as to slacken the recording medium or move the recording medium to a position out of a regular transportation path, it is possible to apply a force of peeling the recording medium from the print head. Consequently, it is possible to readily eliminate sticking of the recording medium with a high success rate.

DETAILED DESCRIPTION OF THE EMBODIMENTS

Hereinafter, embodiments of the present invention will be described with reference to the drawings. In the embodiments, a thermal printer is described as an example of the printer to which the present invention is applied.

(Entire Structure of Printer)

Figure 1:
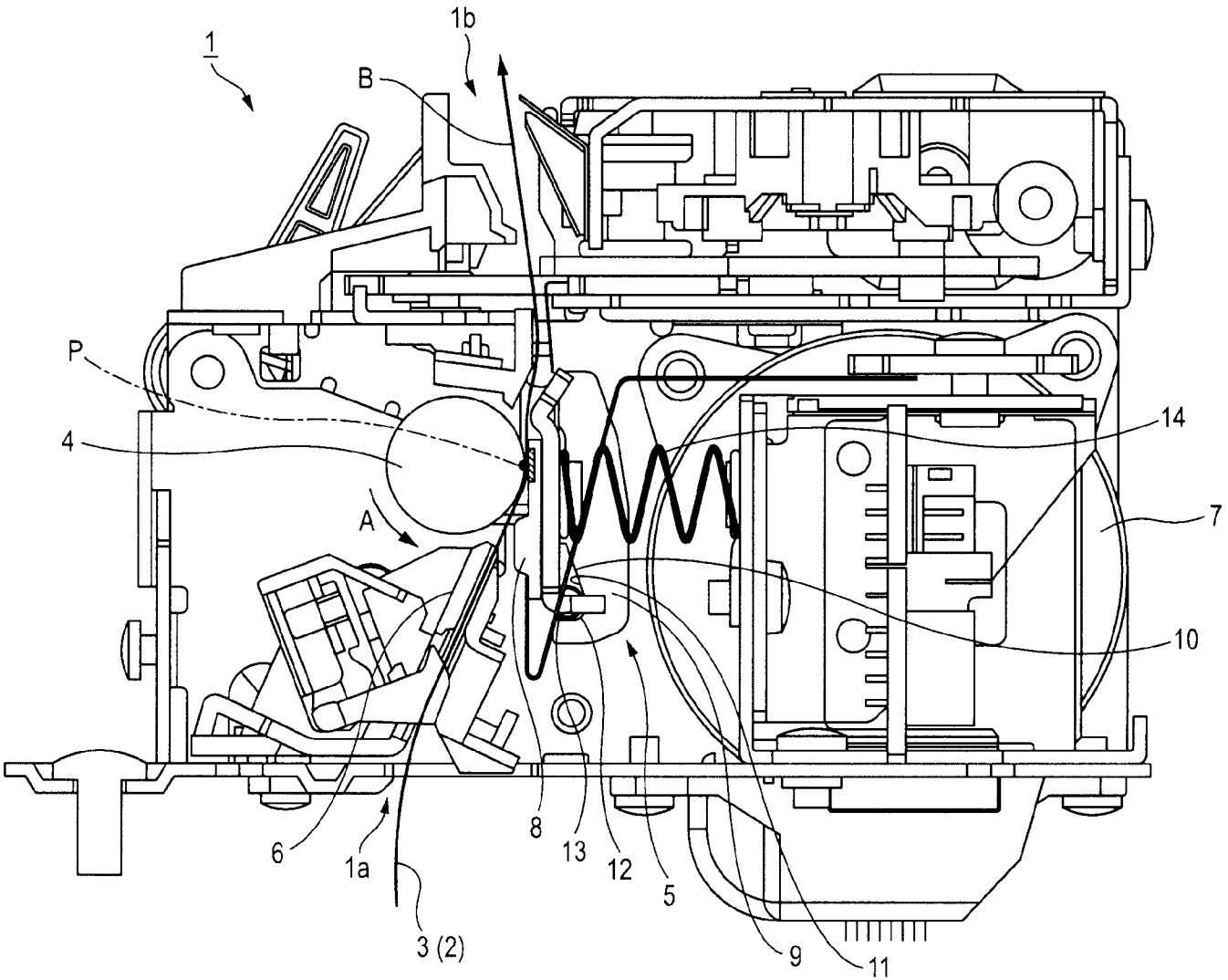
FIG. 1 is an explanatory cross sectional view illustrating a structure of a thermal printer according to an embodiment of the present invention.

FIG. 1 is an explanatory cross sectional view illustrating a structure of the thermal printer according to the embodiment of the present invention. The thermal printer 1 (the printer) is configured to perform printing while transporting long recording paper 2 (a recording medium) along a transportation path 3 in the printer. The thermal printer 1 includes a platen roller 4 arranged at a predetermined position on the transportation path 3, and a thermal head 5 (a print head) arranged so as to face the platen roller 4. A paper inlet 1*a* is provided at a lower face of the thermal printer 1. The recording paper 2 to be supplied into the thermal printer 1 through the paper inlet 1*a* is loaded so as to pass through a position between the thermal head 5 and the platen roller 4. A paper outlet 1*b* is provided at an upper part of the thermal head 5 and the platen roller 4 and the recording paper 2 on which the printing is performed is discharged through the paper outlet 1*b* to the outside of the thermal printer 5. As the recording paper 2, a long thermal paper or a label paper configured such that labels of thermal paper are adhered to a long base paper can be used.

A paper guide member 6 (a guide member) for guiding the recording paper 2 is provided at an upstream side of a paper transportation path between the paper inlet 1*a* and a nipping position P of the thermal head 5 and the platen roller 4. In the embodiment, the paper inlet 1*a* is arranged at a position which is slightly deviated toward the platen roller 4 (the left side in FIG. 1) from a position just below the nipping position P of the recording paper 2 by the thermal head 5 and the platen roller 4. Therefore, a guide path in the paper guide member 6 diagonally extends toward the nipping position P which is positioned at a right upper side with respect to the paper inlet 1*a*. The recording paper 2 that passes through the paper guide member 6 is turned by the platen roller 4 in an upward direction.

A rotational driving force of a transportation motor 7 is transmitted to the platen roller 4 via a transmission mechanism (not shown) such as gears or the like. When the platen roller 4 is rotated in a forward direction (the direction of arrow A in FIG. 1), the recording paper 2 is transported in a forward direction toward the paper outlet 1*b* in association with the rotation. When the platen roller 4 is rotated in a backward direction (the opposite direction of arrow A in FIG. 1), the recording paper 2 is transported backward toward the paper inlet 1*a*. Here, in the specification, the transporting direction (the transporting direction of the recording medium 2 during printing: the direction of arrow B in FIG. 1) of the recording paper 2 from the paper inlet 1*a* toward the paper outlet 1*b* is referred to as "a reference transporting direction".

(Print Head and Supporting Mechanism thereof)

Figure 2:
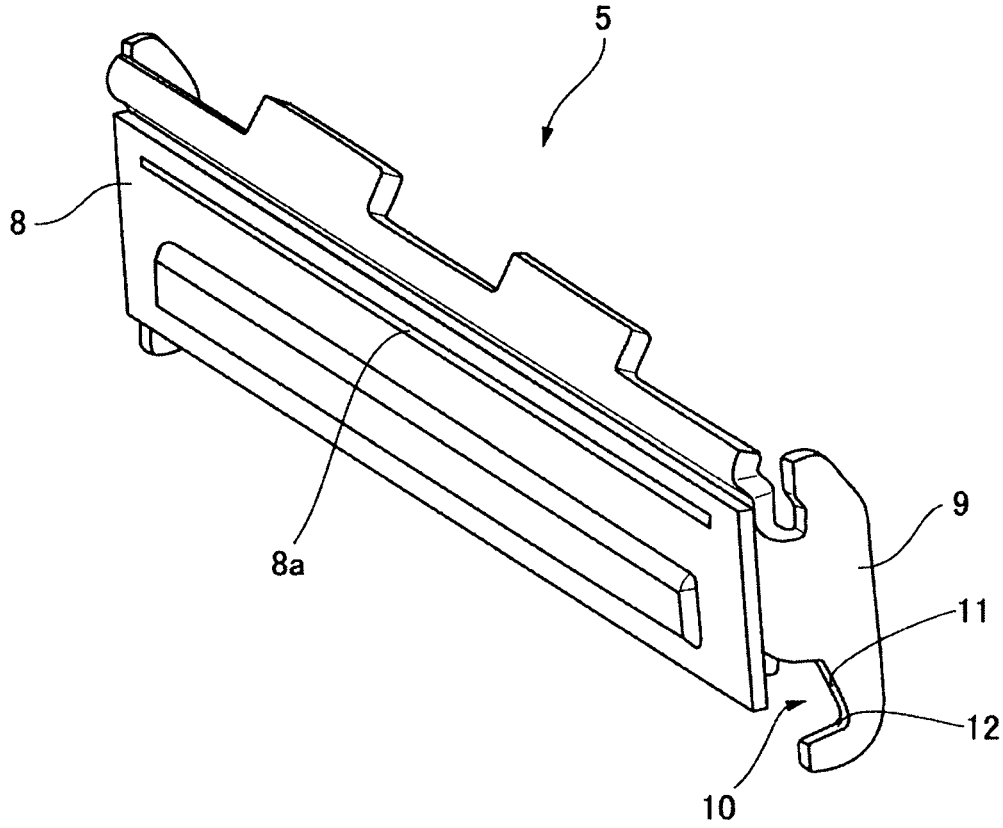
FIG. 2 is a perspective view illustrating a thermal head of the thermal printer according to the embodiment.

FIG. 2 is a perspective view illustrating the thermal head. As shown in FIGS. 1 and 2, the thermal head 5 includes a head body portion 8 which is directed toward the platen roller 4 and a support frame 9 which is arranged at a back side of the head body portion 8. The support frame 9 extends in a vertical direction. A heating section 8*a* for heating the recording paper 2 and performing printing on the recording paper 2 is provided on the head body portion 8 at a portion near the top end thereof. When performing the printing with the thermal head 5, the heating section 8*a* of the head body portion 8 faces the platen roller 4 and the recording paper 2 is nipped between the heating section 8*a* and the platen roller 4.

The support frame 9 is formed with a notch portion 10 at a portion extending toward a lower part of the head body portion 8, that is, at a portion extending toward an upstream side of the heating section 8*a* in the reference transporting direction. The notch portion 10 is opened toward a side where the transportation path 3 is provided. The notch portion 10 is formed into a shallow shape at a side near the pressed portion of the head body portion 8 by the platen roller 4, that is, a side near the heating section 8*a*, and is formed into deep shape at a side away from the heating section 8*a*. A straight line shaped guide surface 11 is provided at a bottom part of the notch portion 10 and a curved shaped rotation support surface 12 is continuously formed at a lower end of the guide surface 11. Here, the guide surface 11 extends to be inclined with respect to the head body portion 8. The inclination direction of the guide surface 11 is a direction of retreating into the back face (the right side in FIG. 1) of the head body portion 8 toward the rotation support surface 12 (the lower side in FIG. 1).

When the thermal head 5 is arranged such that the head body portion 8 faces the platen roller 4, a rotary shaft 13 supported by a body frame of the thermal printer 1 faces an opening of the notch portion 10. The rotary shaft 13 is provided parallel to a rotational axis line of the platen roller 4. The thermal head 5 is urged toward the platen roller 4 by a head pressing spring 14 (an urging member) provided at the back face of the head body portion 8. With an urging force of the head pressing spring 14, the head body portion 8 is pressed against the platen roller 4 and the rotary shaft 13 is pressed against an inner surface of the notch portion 10.

As shown in FIG. 1, when the heating section 8*a* faces the platen roller 4, the rotary shaft 13 is positioned at a lower end of the notch portion 10 so as to be inscribed in the rotation support surface 12. At that time, the rotation support surface 12 can be slid on an outer circumferential surface of the rotary shaft 13 so as to rotate the thermal head 5. That is, the thermal head 5 is supported such that the thermal head 5 is rotatable about the rotary shaft 13.

In addition, when the thermal head 5 is pulled to an upstream side or a downstream side in the reference transporting direction of the recording paper 2 (in the downward direction or the upward direction in FIG. 1), the rotary shaft 13 slides along the guide surface 11 so that the rotary shaft 13 guides and moves the thermal head 5 in a direction corresponding to a pulling direction while the rotary shaft 13 supports the thermal head 5 against the urging force of the head pressing spring 14. With the rotary shaft 13 and the guide surface 11, the thermal head 5 is supported so as to be movable relative to the rotary shaft 13 within a range in a length of the guide surface 11.

(Sticking Eliminating Operation of Recording Paper)

Figure 3A:
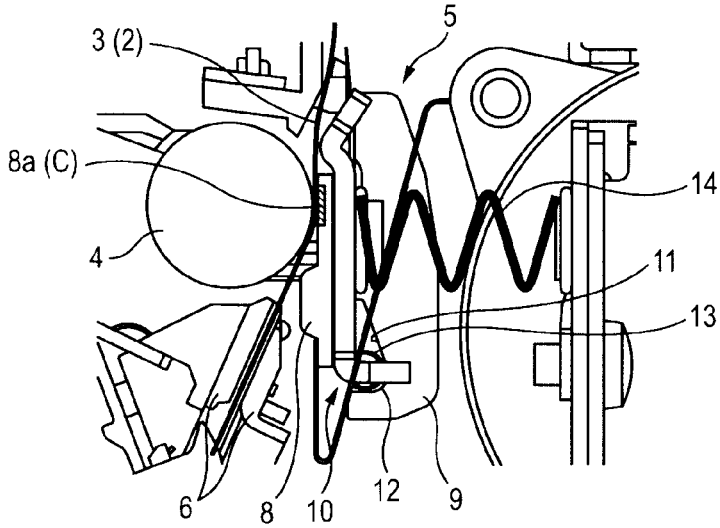
FIGS. 3A to 3C are explanatory views illustrating a sticking eliminating operation for a print head.
Figure 3B:
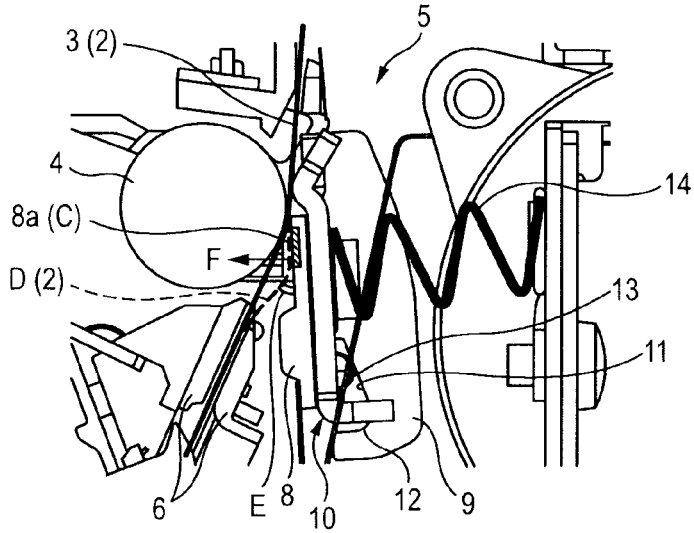
Figure 3C:
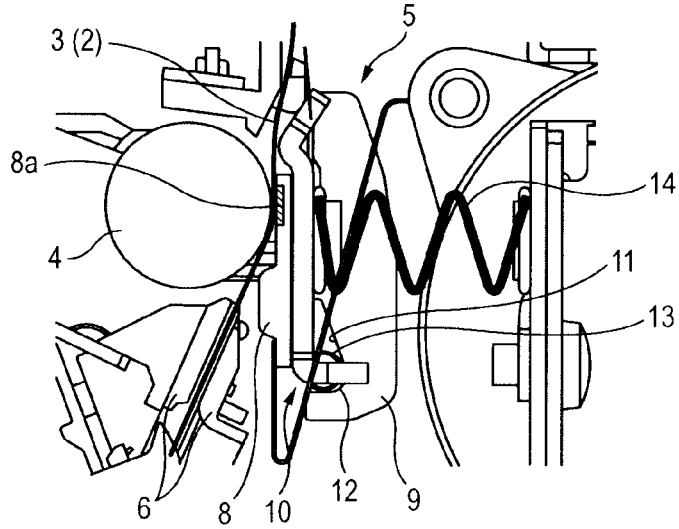

FIGS. 3A, 3B and 3C are explanatory views illustrating a sticking eliminating operation of the recording paper on the print head. FIG. 3A illustrates a state in which the sticking between the print head and the recording paper occurs, FIG. 3B illustrates a state in which the print head is moved so as to allow the sticking portion to be released from the pressure, and FIG. 3C illustrates a state in which the print head is returned to its original position after eliminating the sticking.

In the embodiment, as shown in FIGS. 1 and 3A, when printing is performed on the recording paper 2, the thermal head 5 is positioned at a position where the rotary shaft 13 is inscribed in the rotation support surface 12, and the heating section 8*a* faces the most protruded portion of the platen roller 4 toward the thermal head 5. The thermal head 5 is urged by the head pressing spring 14 in a direction of rotating toward the platen roller 4 about the rotary shaft 13, and the heating section 8*a* is pressed against the platen roller 4 in a state where the recording paper 2 is nipped between the heating section 8*a* and the platen roller 4. In a printing standby state of the thermal printer 1, the above-described state is maintained. Therefore, when the printing standby state is maintained for a long time, the recording paper 2 pressed against a pressed area C centering on the heating section 8*a* may be stuck to the pressed area C by a pressing force.

Figure 4:
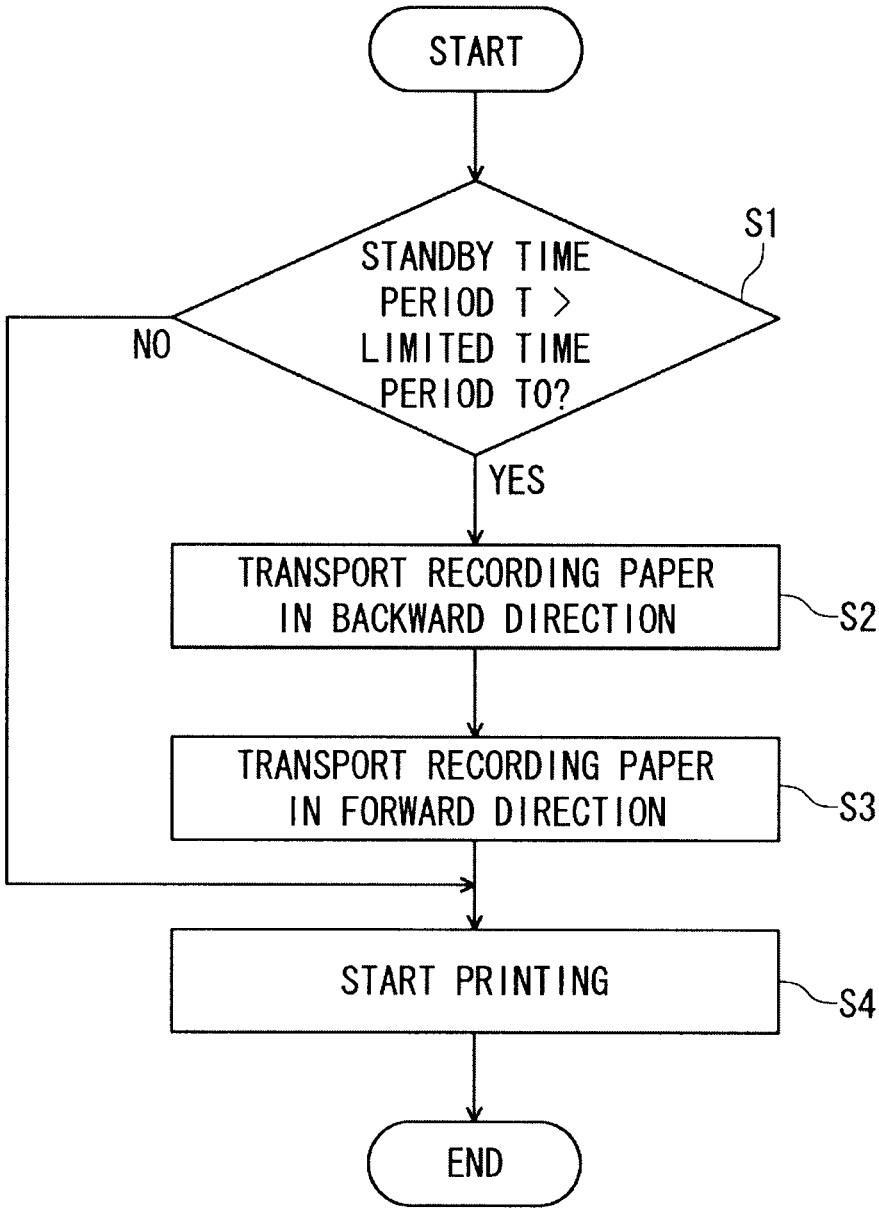
FIG. 4 is a flowchart of the sticking eliminating operation for the print head.

FIG. 4 is a flowchart of the sticking eliminating operation. When a control section of the thermal printer 1 receives an execution command of an operation including transportation of the recording paper 2, such as a printing start command, it is determined whether or not a standby time period T (a duration of the printing standby state) at that time exceeds a predetermined limited time period TO (step S1). If the printing standby state continues for a time period longer than the limited time period TO (step S1: Yes), the process proceeds to step S2. On the other hand, if the standby time period T is equal to or shorter than the limited time period TO (step S1: No), processes of steps S2 to S3 are skipped, the process proceeds to step S4, and then a designated operation such as the printing operation is started.

The control section of the thermal printer 1 performs a transportation operation for transporting the recording paper 2 by a predetermined amount in a direction opposite to the reference transporting direction in step S2. For example, in order to transport the recording paper 2 in the backward direction by a transportation amount corresponding to a length of 24 dots of the print dots formed by the thermal head 5, the platen roller 4 is rotated in the backward direction by a rotational amount corresponding to the backward transportation of the platen roller by 24 dots. With this operation, a transportation force toward the upstream side in the reference transporting direction acts on a portion of the recording paper 2, stuck to the pressed area C so that the thermal head 5 is pulled toward the upstream side in the reference transporting direction via the recording paper 2.

Since the rotary shaft 13 is slidable along the guide surface 11, the thermal head 5 is supported so as to be movable relative to the platen roller 4. When the thermal head 5 is pulled toward the upstream side via the recording paper 2 stuck to the pressed area C, the rotary shaft 13 slides along the guide surface 11 so that the thermal head 5 as a whole moves toward the same side as the pulling direction. When the thermal head 5 is moved relative to the platen roller 4, the pressing position is shifted from the pressed area C toward the downstream side in the reference transporting direction. As shown in FIG. 3B, the backward transportation amount in step S2 is a transportation amount by which the thermal head 5 can be moved until the pressed area C is completely removed from the pressing position by the platen roller 4. Therefore, by performing the process of step S2, the pressed area C is moved toward the upstream side so as to be completely released from the pressure.

In addition, when moving the thermal head 5 in step S2, the movement thereof is restricted by the platen roller 4 to which the upper portion of the head body portion 8 is pressed and by the rotary shaft 13 which is pressed against the guide surface 11. By this restriction, the thermal head 5 is not moved in a direction completely the same as the pulling force. The thermal head 5 is moved in a diagonally lower right direction in parallel with the guide surface 11 while the thermal head 5 as a whole is slightly rotated in a direction that the upper part thereof is inclined toward the platen roller 4 (in a counterclockwise direction in FIG. 3B). Therefore, the pressed area C is moved to a position out of the regular transportation path 3, and the recording paper 2 stuck to the pressed area C is also moved to a position out of the regular transportation path 3. Accordingly, the recording paper 2 becomes in a posture that the recording paper diagonally rises from the head face so as to have a predetermined rising angle E at the upstream side of the pressed area C so that a force of peeling and raising the recording paper 2 from the pressed area C (a force acting in a direction F in FIG. 3B) acts thereon. Therefore, the recording paper 2 can be peeled more readily rather than a conventional method of peeling by a shear force.

In addition, in the embodiment, the paper guide member 6 extending toward a position near the platen roller 4 is provided at the upstream side in the transportation path 3 so as to guide the recording paper 2. Thus, when the pressed area C is moved to a position out of the regular transportation path 3, the recording paper 2 is slackened along a flexure path D indicated by a dotted line in FIG. 3B in a short interval from the paper guide member 6 to the pressed area C. This slacking state is a slacking state in which the rising angle E is large at a portion where the recording paper 2 rises from the head face and is a slacking state in which a force of peeling and raising the recording paper 2 from the pressed area C is large. That is, by forming this slacking state, the recording paper 2 can be peeled with a high success rate. Since the rising angle E of the recording paper 2 is gradually increased in a process of moving the thermal head 5 from a state shown in FIG. 3A to a state shown in FIG. 3B, the force of peeling and raising the recording paper 2 is gradually increased. Accordingly, the recording paper 2 can be smoothly peeled.

Meanwhile, in a case where the paper guide member 6 is omitted, a path of the recording paper 2 at the upstream side is not limited so that the recording paper 2 can be gently slackened with a large curvature. Therefore, the rising angle E of the recording paper 2 does not become so large. However, since the force of peeling and raising is applied, it is possible to peel the recording paper 2 more readily than a conventional method of peeling by a shear force. In addition, even when a moving destination of the pressed area C is not so much shifted from the regular transportation path 3, a flexure of the recording paper 2 is generated by the backward transportation, so that a force of peeling and raising, although which is not so large as in the above case, acts thereon. Accordingly, it is possible to peel the recording paper 2 more readily than a conventional method of peeling only by a shear force.

The process of the control section of the thermal printer 1 proceeds to step S3 after the operation in step S2 is completed, and the recording paper is transported in the forward direction (the reference transporting direction) by a transportation amount the same as the backward transportation amount in step S2. For example, the platen roller 4 is rotated forward by a rotational amount corresponding to the forward transportation of 24 dots. With this operation, as shown in FIG. 3C, the recording paper 2 is returned to a position before the standby state, and the printing start position of the recording paper 2 is positioned at the nipping position P of the platen roller 4. In addition, the thermal head 5 pressed against the recording paper 2 to be transported in the reference transporting direction is pulled toward the downstream side together with the recording paper 2 so that the thermal head 5 is moved backward in the movement path on which it is moved in step S2, and the recording paper 2 is nipped between the heating section 8*a* and the platen roller 4. Meanwhile, at that time, since the guide surface 11 is inclined, the urging force of the head pressing spring 14 acts as a force of sliding the entirety of the thermal head 5 toward a diagonally left upper side along a direction of the guide surface 11. With the above, when the thermal head 5 is returned, the process proceeds to step S4 and a designated operation such as a printing operation is started.

Thus, the thermal printer 1 of the embodiment includes the supporting mechanism for the thermal head 5 that can apply a force of peeling and raising the recording paper 2 stuck to the head body portion 8 by releasing the recording paper 2 from the pressure of the platen roller 4. With the above configuration, it is possible to readily and surely eliminate the sticking In addition, the sticking eliminating operation that is adapted to move the thermal head in a movable range of the thermal head 5 by means of the supporting mechanism can be performed only by the back and forth rotations of the platen roller 4. Therefore, it is not necessary to newly provide a driving force of moving the thermal head, and the eliminating of the sticking can be achieved at low cost.

MODIFICATION EXAMPLES (1) In the above embodiment, while the pressing position of the platen roller 4 is shifted by transporting the recording paper 2 toward the upstream side in the reference transporting direction, it is also possible to release the sticking portion from the pressure by transporting the recording paper 2 toward the downstream side in the reference transporting direction. For example, it is sufficient to rearrange the thermal head 5 and the rotary shaft by reversing the vertical orientation of them in FIG. 1 with reference to the pressing position of the platen roller 4. With this configuration, it is possible to eliminate the sticking by transportation in the reference transporting direction. In addition, at that time, by providing a paper guide member to a portion in front of the paper outlet 1*b*, it is possible to positively apply a force of peeling and raising the recording paper 2 similarly to the paper guide member 6 in the above embodiment.

(2) While the backward transportation operation and the transportation operation in the forward direction are performed by one time in the above embodiment, respectively as the sticking eliminating operation, the backward transportation operation and the transportation operation in the forward direction can be performed by a plurality of number of times. With this, it is possible to surely peel the recording paper 2 strongly stuck thereto.

(3) While the notch portion 10 opened toward the transportation path 3 is provided and the guide surface 11 for sliding the rotary shaft 13 is provided at the bottom part thereof in the above embodiment, it is possible that an elongated hole extending in a direction the same as the guide surface 11 is formed instead of the notch portion 10 and the rotary shaft 13 is attached to the elongated hole.

(4) In order to ensure the returning of the thermal head 5 in step S3 in the above embodiment, it is possible to provide an urging member or the like for pulling upward the thermal head 5 (downstream side in the reference transporting direction).

(5) While the recording paper 2 is stuck to the thermal head 5 mainly at the heating section 8*a* in the above embodiment, the sticking position (the nipping position of the recording paper 2) is not limited to a portion where the heating section 8*a* is provided.

(6) While the above embodiment is that the invention is applied the thermal printer 1, the invention can be applied to another printer. That is, the invention can be applied to any printer in which a recording medium is nipped between a platen roller and a print head and is pressed thereby, and the recording medium can be stuck to the print head when the recording medium is left in this pressing state during a standby time for printing. In addition, the invention can be applied to a printer that performs printing on a recording medium such as a paper with a coating layer on a printing face thereof or a label paper.

(7) While the thermal head 5 is pulled and moved by the transportation force for transporting the recording paper 2, it is possible that the thermal head 5 is moved by a driving source other than the transporting unit of the recording paper 2 so as to shift a contact position with the platen roller 4. The driving source other than the transporting unit of the recording paper 2 can assist a torque of the platen roller 4.

(8) While the head body portion 8 which comes in contact with the platen roller 4 has a surface parallel to a vertical surface in the configuration of the thermal printer 1 according to the above embodiment, the invention is not limited to this arrangement. The head body portion 8 may be inclined with respect to the vertical surface and come in contact with the platen roller 4. Even when the head body portion 8 comes in contact with the platen roller 4 in this manner, the advantageous effects of the above embodiment can be obtained by arranging the paper inlet 1*a* and the paper guide member 6 at a side of the platen roller 4 with respect to a vertical surface passing through the center of the pressed area C (the hatched area of the head body portion 8 in FIGS. 3A to 3C), which is a nipping region between the platen roller 4 and the head body portion 8, in the transporting direction of the recording medium. That is, the paper inlet 1*a* and the paper guide member 6 are arranged at the side of the platen roller 4 with respect to a virtual surface including a tangent line of the platen roller 4, which passes through the center of the pressed area C in the transporting direction of the recording paper 2. Consequently, the recording paper 2 can be wound around the platen roller 4. In addition, by extending the guide surface 11 formed in the support frame 9 which constitutes the supporting mechanism in a direction away from the virtual surface, the guide surface 11 slides along the rotary shaft 13 provided in the thermal printer 1 and the support frame 9 moves. Due to the movement of the support frame 9, the head body portion 8 which is supported by the support frame 9 also moves and the pressed area C of the head body portion 8 is shifted to a position where the pressing force is released. At this time, the rotary shaft 13 is positioned at a side of the head body portion 8 with respect to the virtual surface.

(9) The control section of the thermal printer 1 according to the above embodiment performs a control of rotating the platen roller 4 by a rotational amount corresponding to the backward transportation of 24 print dots formed by the thermal head 5 in step S2. 24 print dots formed by the thermal head 5 correspond to a distance sufficiently larger than a moving direction corresponding to the pressed area C. The present invention is not limited to the above operation. A length L of the pressed area C in the transporting direction of the recording paper in the embodiment, although it varies depending on the pressing force of the head body portion 8 and the platen roller 4 and the hardness of the platen roller 4, corresponds to about 10 to 12 print dots.

The configuration of the above embodiments is for preventing the sticking of the recording paper 2 to the thermal head 5. In order to eliminate the sticking due to the heating section 8*a* which is the printing portion of the thermal head 5, the following operation is performed. In a case where the sticking eliminating operation is performed by moving the thermal head 5 upstream in the transporting direction of the recording paper, the thermal head 5 (i.e., the head body portion 8) is moved by a distance equal to or greater than a distance L1 (<L) from an upstream end of the pressed area C in the transporting direction of the recording paper to the heating section 8*a*. On the other hand, in a case where the sticking eliminating operation is performed by moving the thermal head 5 downstream in the transporting direction of the recording paper, the thermal head 5 (i.e., the head body portion 8) is moved by a distance equal to or greater than a distance L2 (<L) from a downstream end of the pressed area C in the transporting direction of the recording paper to the heating section 8*a*. If the heating section 8*a* is located at the center of the pressed area C, L1 is equal to L2 and is equal to ½L. By moving the thermal head 5 by a distance from the end portion of the pressed area C at a side of the moving direction of the thermal head 5 to the heating section 8*a*, the sticking due to the heating section 8*a* can be eliminated.

In order to eliminate the sticking due to the pressing force of the pressed area C, the thermal head 5 is moved by at least the distance L of the pressed area C in the transporting direction of the recording paper or more. This leads to release of the pressing force to the recording paper 2 at a position corresponding to the pressed area C to which the pressing force is applied at the time of printing standby state, and thus the sticking can be eliminated.

(10) In the above embodiment, the force of peeling and raising the recording paper 2 acts even when the paper guide member 6 is omitted. This is because when the thermal head 5 moves upstream in the transporting direction of the recording paper 2, the recording paper 2 at a position other than the position corresponding to the pressed area C is supported by the pressing force of the head body portion 8 and the platen roller 4 at a downstream side of the recording paper 2 in the transporting direction of the recording paper 2. On the other hand, at an upstream side of the recording paper 2 in the transporting direction of the recording paper 2, the upstream end of the recording paper 2 is supported by the paper inlet 1*a* or, if a roll paper is used as the recording paper 2, by a roll. Since the upstream end of the recording paper 2 is supported at a position away from the thermal head 5 compared to the paper guide member 6, the force of peeling and raising is not so strong, but the force acts on the recording paper 2.

(11) The standby time period T (the duration of the printing standby state) corresponds to a time period from a time at which the recording paper 2 is stopped at the nipping position (the pressed area at the time of the printing standby) to a time of receiving the printing start command including a transportation operation of the recording paper 2. In particular, the standby time period T corresponds to a time period from a time at which the printing operation is terminated and the platen roller 4 is stopped in a state where the head body portion 8 is pressed against the platen roller 4 to a time of receiving the next printing command. This time period is measured by a timer (a timer means) which is not shown, and the standby time period T is obtained from the measured information. Even if the power is turned off in a state where the platen roller 4 is stopped, the timer measures the time as the standby time period as long as a state where the platen roller 4 is pressed against the head body portion 8 is continued.

(12) In the above embodiment, when the operation in step S2 is completed, the operation goes to step S3 to transport the recording paper 2 in the forward direction by the same transporting amount as the backward transporting amount in step S2. The present invention is not limited to this operation. For example, in order to prevent the recording paper 2 located at the pressed area C at the time of the printing standby from being printed thereon, it is possible to transport the recording paper 2 at a distance greater than the backward transporting amount. In order to prevent the entire region of the recording paper 2 located at the pressed area C at the time of the printing standby from being printed thereon, it is possible to move the recording paper 2 at a distance obtained by adding a distance of the pressed area C in the transporting direction of the recording paper 2 to the backward transporting amount or more.

What is claimed is:

1. A control method for a printer, comprising:

receiving an execution command of an operation including a rotation of a platen roller in a first direction and a transportation of a recording medium;

counting a duration of a printing standby state until the execution command is received; and moving a head body portion of a print head by a rotation of the platen roller in a second direction opposite to the first direction, wherein a contact position of the head body portion with respect to a platen roller is shifted while maintaining the head body portion pressed against the platen roller when the duration of the printing standby state exceeds a predetermined limited period.

2. The control method for the printer according to claim 1, wherein the printing standby state is a state in which the recording medium is stopped at a contact position between the head body portion and the platen roller.

* * * * *